US006218349B1

(12) United States Patent
Kravitz et al.

(10) Patent No.: US 6,218,349 B1
(45) Date of Patent: Apr. 17, 2001

(54) COMPOSITION SUITABLE FOR REMOVING PROTEINACEOUS MATERIAL

(75) Inventors: Joseph I. Kravitz, Champlin; Richard O. Ruhr, Buffalo; Michael E. Besse, Golden Valley, all of MN (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 09/528,799

(22) Filed: Mar. 17, 2000

(51) Int. Cl.[7] ..... C11D 1/62; C11D 1/835; C11D 3/36; C11D 7/08

(52) U.S. Cl. ..... 510/218; 510/234; 510/237; 510/253; 510/259; 510/269; 510/289; 510/356; 510/436; 510/503; 510/504

(58) Field of Search ..... 510/218, 234, 510/237, 253, 259, 269, 289, 356, 436, 503, 504

(56) References Cited

U.S. PATENT DOCUMENTS 5,998,358 * 12/1999 Herdt et al. ..... 510/506

* cited by examiner

*Primary Examiner*—Yogendra Gupta
*Assistant Examiner*—Charles Boyer
(74) *Attorney, Agent, or Firm*—Schwegman, Lundberg, Woessner & Kluth, P.A.

(57) ABSTRACT

The present invention provides for a composition suitable for removing proteinaceous material comprising water, an emulsifier, a chelating agent, one or more mineral acids, and a surfactant; wherein: the emulsifier is a polyether nonionic emulsifier or an amine oxide; the chelating agent is an alkylaminophosphonic acid, a hydroxyalkylphosphonic acid, or an alkylphosphonic acid carboxylic acid; the one or more mineral acids are present in an mount such that the pH of the composition is less than about 4.5; and the surfactant is a compound of formula (I):

(I)

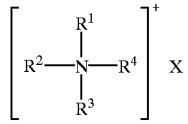

wherein $R^1$, $R^2$, and $R^3$ are independently $(C_1–C_6)$alkyl wherein any alkyl group can be substituted with one or more $(C_1–C_6)$alkoxy or hydroxy; $R^4$ is $$—[R^5—O]_q—H$$

or $$—[R^6—O]_q—[R^7—O]_r—H$$

wherein $R^5$ and $R^6$ are independently $(C_1–C_6)$alkylene, wherein any alkylene group can be substituted with one or more $(C_1–C_6)$alkoxy or hydroxy; $R^7$ is $(C_1–C_6)$alkylene wherein the alkylene group can be substituted with one or more $(C_1–C_6)$alkoxy or hydroxy; q has an average value between about 1 and about 100; r has an average value between about 1 and about 100; and X is halo, $RCOO^-$, $PO_4^{2-}$ or $SO_4^{2-}$ wherein R is $(C_1–C_6)$alkyl.

28 Claims, No Drawings

COMPOSITION SUITABLE FOR REMOVING PROTEINACEOUS MATERIAL

BACKGROUND OF THE INVENTION

Periodic cleaning and sanitizing in the food process industry is a regimen mandated by law and rigorously practiced to maintain the exceptionally high standards of food hygiene and shelf-life expected by today's consumer. Residual food soil left on food contact equipment surfaces can harbor and nourish the growth of opportunistic pathogen and food spoilage microorganisms. These pathogen and microorganisms can contaminate foodstuffs processed in close proximity to the residual soil. Insuring protection of the consumer against potential health hazards associated with food borne pathogens and toxins requires diligent cleaning and soil removal from any surface that contacts the food product directly or any surface that is associated with the processing environment.

Because of food quality concerns and public health pressures, the food processing industry has attained a high standard of practical cleanliness and sanitation. This has not been achieved without great expense, and there is considerable interest in more efficient and less costly technology to effectuate this goal.

The food process industry has come to rely on detergent efficiency in removing food soil from surfaces that contact food products. A major challenge of detergent development for the food process industry includes (1) the successful removal of food soils that are resistant to conventional treatment and (2) the elimination of chemicals that are not compatible with food processing. One such food soil is protein, and two such chemicals are chlorine (or chlorine yielding compounds) and quaternary ammonium compounds, both of which can be incorporated into detergent compositions or can be added separately to cleaning programs for protein removal.

Protein soil residues, often called protein films, occur in all food processing industries but the problem is heightened in the dairy industry because dairy products are among the most perishable of major foodstuffs and any soil residues have serious quality consequences. Protein soil residues are common in the fluid milk and milk by-products industry, including dairy farms. This is no surprise because protein constitutes approximately 27% of natural milk solids, (Harper, W. J., *Milk Components and Their Characteristics*, Dairy Technology and Engineering (editors Harper, W. J. and Hall, C. W.) pp. 18–19, The AVI Publishing Company, Westport, 1976).

Hypochlorite is well-known as a proteinaceous cleaning aid and is often used as an ingredient in continuous in-place (CIP) alkaline detergent compounds was found to help remove protein film. As a result, the food process industry currently employs this technology. Chlorine degrades proteins by the oxidative cleavage and hydrolysis of the peptide bond, which breaks apart large protein molecules into smaller peptide chains. The conformational structure of the protein disintegrates, dramatically lowering the binding energies, and effecting desorption from the surface, followed by solubilization or suspension into the cleaning solution.

The use of chlorinated detergent solutions in the food process industry, however, is not without problems. Corrosion is a constant concern, as is the degradation of polymeric gaskets, hoses, and appliances. Available chlorine concentrations must initially be at least 75 ppm, and preferably, 100 ppm for optimum protein film removal. At concentrations of available chlorine less than 50 ppm, protein soil build-up is enhanced by formation of insoluble, adhesive chloroproteins. Chlorine concentrations are not easy to maintain or analytically discern in detersive solutions. The effectiveness of chlorine on protein soil removal diminishes as solution temperature and pH decrease, lower temperatures affecting reaction rate, and lower pH favoring chlorinated moieties other than the $OCl^-$ peptizing species. High temperature and high pH are therefore desirable for peptizing proteins in general. However, in the case of milk proteins, high temperature and high pH lead to denaturing the protein making its removal more difficult. In addition, the high temperatures associated with cleaning heat transfer, food-contact surfaces, typically greater than 165° F., causes off-gassing of chlorine from the chlorinated alkaline cleaner leading to corrosion of the stainless steel equipment. The problems associated with the use and applications of chlorine-containing cleaning agents in the food processing industry have been known and tolerated for decades. However, no safe, effective, and relatively inexpensive alternative has been advanced by the detergent manufacturers.

The chlorine releasing compounds (e.g., organochloro compounds) pose an additional problem. There is a growing public concern over the health and environmental impacts of chlorine and organochlorines. Whatever the merits of the scientific evidence regarding carcinogenicity, there is little argument that organohalogen compounds are persistent and bioaccumulative; and that many of these compounds pose greater non-cancer health effects (e.g., endocrine, immune, and neurological problems) principally in the offspring of exposed humans and wildlife, at extremely low exposure levels. It is, therefore, prudent for the food process industry and their detergent suppliers to focus on finding cleaning compositions that do not include chlorine releasing agents.

The other well-known cleaning aid, quaternary ammonium compounds, do not have the health, environmental, and application difficulties of chlorinated detergents. However, quaternary ammonium compounds are highly substantive to metal surfaces and often have residual kill activity. This property has resulted in the deactivation of cheese-making cultures that come into contact with the routinely cleaned surface. As such, these quaternary ammonium compounds are not suitable as components of cleansing or sanitizing solutions for surface areas that may contact cheese-making cultures.

A substantial need therefore exists for novel, safe, and effective compositions that are suitable for removing proteinaceous material in the food process industry. The composition should not include chlorine, or a chlorine containing compound. In addition, the composition should not include a compound that has residual kill activity in the dairy industry.

SUMMARY OF THE INVENTION

The present invention is directed to a composition suitable for use as a cleaning agent for removal of proteinaceous material. The composition includes water, an emulsifier, a chelating agent, one or more mineral acids, and a surfactant. The emulsifier is a polyether nonionic emulsifier or an amine oxide. The chelating agent is an alkylaminophosphonic acid, a hydroxyalkylphosphonic acid, or an alkylphosphonic acid carboxylic acid. The one or more mineral acids are present in an mount such that the pH of the composition is less than about 4.5. The surfactant is a quaternary ammonium compound of formula (I):

(I)

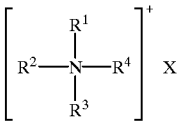

wherein $R^1$, $R^2$, and $R^3$ are independently $(C_1-C_6)$alkyl wherein any alkyl group can be substituted with one or more $(C_1-C_6)$alkoxy or hydroxy; $R^4$ is $$-[R^5-O]_q-H$$

or $$-[R^6-O]_q-[R^7-O]_r-H$$

wherein $R^5$ and $R^6$ are independently $(C_1-C_6)$alkylene, wherein any alkylene group can be substituted with one or more $(C_1-C_6)$alkoxy or hydroxy; $R^7$ is $(C_1-C_6)$alkylene wherein the alkylene group can be substituted with one or more $(C_1-C_6)$alkoxy or hydroxy; q has an average value between about 1 and about 100; r has an average value between about 1 and about 100; and X is halo, $RCOO^-$, $PO_4^{2-}$ or $SO_4^{2-}$ wherein R is $(C_1-C_6)$alkyl.

The present invention also directed to a method for removing proteinaceous material. The method includes (1) contacting a surface having proteinaceous material with an effective amount of a composition of the present invention and for an effective period of time to remove the proteinaceous material and (2) removing the proteinaceous material from the surface.

It has been discovered that at the concentrations and conditions used, the composition with the quaternary ammonium surfactant ingredient has little or no residual kill activity toward dairy culture microorganisms, yet the composition provides an effective cleaning agent for removal of proteinaceous, especially dairy material.

DETAILED DESCRIPTION OF THE INVENTION

The present invention provides a composition suitable for removing proteinaceous material from food processing (e.g., dairy) equipment. The composition can effectively reduce the time, reduce the volume of water, and reduce the amount of caustic chemicals necessary to remove the proteinaceous material. The composition, which includes a quaternary ammonium compound, has little or no biocidal effect (i.e., residual kill activity) at anticipated residual levels. In addition, the composition does not include harmful or caustic compounds (e.g., chlorine or chlorine generating compounds).

In cases where compounds employed in the present invention are sufficiently basic or acidic to form stable nontoxic acid or base salts, use of the compounds as salts may be appropriate. Examples of acceptable inorganic salts include hydrochloride, sulfate, nitrate, bicarbonate, and carbonate salts. Suitable salts may be obtained using standard procedures well known in the art, for example by reacting a sufficiently basic compound such as an amine with a suitable acid affording a physiologically acceptable anion. Alkali metal (e.g., sodium, potassium or lithium) or alkaline earth metal (e.g., calcium) salts of carboxylic acids can also be made.

The following definitions are used, unless otherwise described: halo is fluoro, chloro, bromo, or iodo. Alkyl, alkylene, alkoxy, etc. denote both straight chained and branched groups.

The composition includes water. The water can optionally be distilled, purified, or deionized. The concentrated form of the composition will include less water than the composition used for removing proteinaceous material. The water can be present up to about 99.00 wt. % of the concentrated composition. Preferably, the water can be present up to about 50.00 wt. % of the concentrated composition. The concentrated form of the composition will typically be less expensive to ship, handle and store than the composition used for removing proteinaceous material. The concentrated form of the composition will be re-constituted or diluted prior to use to provide the composition. The composition can then be used for removing proteinaceous material. The water can be present in about 90.00 wt. % to about 99.99 wt. % of the composition. More preferably, the water can be present in about 94.88 wt. % to about 99.99 wt. % of the composition.

The surfactant is a compound of formula (I):

(I)

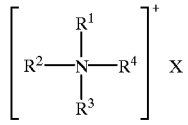

wherein $R^1$, $R^2$, and $R^3$ are each independently $(C_1-C_6)$alkyl wherein any alkyl group can be substituted with one or more $(C_1-C_6)$alkoxy or hydroxy;

$R^4$is $$-[R^5-O]_q-H$$

or $$-[R^6-O]_q-[R^7-O]_r-H$$

wherein $R^5$ and $R^6$ are independently $(C_1-C_6)$alkylene wherein any alkylene group can be substituted with one or more $(C_1-C_6)$alkoxy or hydroxy;

$R^7$ is $(C_1-C_6)$alkylene wherein the alkylene group can be substituted with one or more $(C_1-C_6)$alkoxy or hydroxy;

q has an average value between about 1 and about 100;

r has an average value between about 1 and about 100; and

X is halo (e.g., chloro, fluoro, bromo, or iodo), $RCOO^-$, $PO_4^{2-}$ or $SO_4^{2-}$ wherein R is $(C_1-C_6)$alkyl.

A preferred value for $R^1$ is ethyl. A preferred value for $R^2$ is methyl. A preferred value for $R^3$ is ethyl. A preferred value for $R^4$ is $[CH_2C(H)(CH_3)O]_n$, wherein n has an average value between about 1 and about 100. More preferably, n has an average value of about 40. A preferred value for $R^5$ is $CH_2C(H)(CH_3)$. A preferred value for q is an average value of about 9, an average value of about 20, an average value of about 25, or an average value of about 40. A more preferred value for q is an average value of about 40. A preferred value for $R^6$ is $CH_2C(H)(CH_3)$. A preferred value for $R^7$ is $CH_2C(H)(CH_3)$. A preferred value for r is an average value of about 20. A preferred value for X is chloro, fluoro, bromo, iodo, $RCOO^-$, $PO_4^-$, or $SO_4^{2-}$, wherein R is methyl, ethyl, propyl, iso-propyl, butyl, or sec-butyl. More preferably, X is chloro.

The surfactant can be present in any suitable amount of the composition, provided the composition can effectively remove proteinaceous material and provided none of the components of the composition has a significant residual kill activity, especially in the dairy industry. Preferably, the surfactant can be present in about 0.0001 wt. % of the composition to about 1.0 wt. % of the composition. More preferably, the surfactant can be present in about 0.0001 wt. % of the composition to about 0.1 wt. % of the composition.

Suitable surfactants include PPG-9 diethylammonium chloride, which is commercially available as Emcol CC9 from Witco (Greenwich, Conn.); PPG-25 diethylammonium chloride, which is commercially available as quaternium-20 from Witco (Greenwich, Conn.); or PPG-40 diethylammonium chloride, which is commercially available as Emcol CC42 from Witco (Greenwich, Conn.) or Glensurf 42 (CAS # 68132-96-7). More preferably, the surfactant is PPG-40 diethylammonium chloride, Glensurf 42 from Glenn Chemical (St. Paul, Minn.).

The emulsifier is a polyether nonionic emulsifier or an amine oxide. The polyether nonionic emulsifier is a compound of formula (III):

$$R^{10}—O—(R^{11}O)_m—[R^{12}O]_n—H \quad \text{(III)}$$

wherein $R^{10}$ is $(C_8–C_{20})$alkyl wherein the alkyl can be substituted with one or more $(C_1–C_6)$alkoxy or hydroxy or a $C_1–C_{12}$ alkylphenol;

$R^{11}$ and $R^{12}$ are each independently $(C_1–C_6)$alkylene wherein each alkylene can be substituted with one or more $(C_1–C_6)$alkoxy or hydroxy;

m has an average value of about 5 to about 200; and n has an average value of about 0 to about 200.

A preferred value for $R^{10}$ is $(C_{10}–C_{18})$alkyl. More preferably, the alkyl group can be linear (i.e., normal or straight chained). A preferred value for $R^{11}$ is ethylene.

A preferred value for $R^{12}$ is butylene. More preferably, $R^{12}$ can be $—CH_2CH_2CH_2CH_2—$. A preferred value for m is an average value of about 5 to about 50. A preferred value for n is an average value of about 1 to about 2.

The polyether nonionic emulsifier can be present in any suitable amount of the composition, provided the composition can effectively remove proteinaceous material and provided none of the components of the composition has a significant residual kill activity, especially in the dairy industry. Preferably, the polyether nonionic emulsifier can be present in about 0.0001 wt. % of the composition to about 2.0 wt. % of the composition. More preferably, the polyether nonionic emulsifier can be present in about 0.0002 wt. % of the composition to about 0.2 wt. % of the composition.

One suitable polyether nonionic emulsifier is a nonionic linear alkoxylated primary alcohol, which is commercially available as Dehypon LT 104 from Henkel (Dusseldorf, Germany; CAS # 146340-16-1 or Plurafac LF-221 from BASF (Mount Olive, N.J.).

The amine oxide emulsifier can be a compound of formula (IV):

(IV)

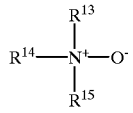

wherein $R^{13}$ and $R^{15}$ are each independently $(C_1–C_6)$alky wherein each alkyl can optionally be substituted with one or more hydroxy; and $R^{14}$ is $(C_6—C_{16})$alky.

A preferred value for $R^{13}$ is methyl. A preferred value for $R^{14}$ is iso-alkyl. As used herein, iso-alkyl is $(C_3–C_6)$alkyl having a single carbon branch on the next-to-last carbon of a chain and the point of attachment is at the opposite end of the chain (i.e., $(CH_3)(CH_3)CH(CH_2)_n—$, wherein n is 0–3). See, Morrison and Boyd, *Organic Chemistry,* 4th Edition, pp. 88–89, 1983. For example, iso-alkyl can be isopropyl, isobutyl, isopentyl, or isohexyl. A preferred value for $R^{15}$ is methyl.

The amine oxide emulsifier can be present in any suitable amount of the composition, provided the composition can effectively remove proteinaceous material and provided none of the components of the composition has a significant residual kill activity, especially in the dairy industry. Preferably, the amine oxide emulsifier can be present in about 0.0001 wt. % of the composition to about 2.0 wt. % of the composition. More preferably, the amine oxide emulsifier can be present in about 0.0002 wt. % of the composition to about 0.2 wt. % of the composition.

One suitable amine oxide emulsifier is iso-alkyl dimethyl amine oxide, which is commercially available as Barlox 12i (CAS No. 151151-28-9) from Lonza Inc. (Fairlawn, N.J.).

The chelating agent is an alkylaminophosphonic acid, a hydroxyalkylphosphonic acid, or an alkylphosphonic acid carboxylic acid.

The chelating agent can be present in any suitable amount of the composition, provided the composition can effectively remove proteinaceous material and provided none of the components of the composition has a significant residual kill activity, especially in the dairy industry. Preferably, the chelating agent can be present in about 0.0001 wt. % of the composition to about 5.0 wt. % of the composition. More preferably, the chelating agent can be present in about 0.0005 wt. % of the composition to about 0.5 wt. % of the composition.

The alkylaminophosphonic acid can be $(C_3–C_{16})$alkyl substituted on carbon with one or more phosphonic acid (i.e., $PO_3H_2$) groups wherein one or more carbon atoms are interrupted with one or more nitrogen (i.e., N) atoms. Preferably, the $(C_3–C_{16})$alkyl can be substituted on carbon with 3, 4, or 5 phosphonic acid (i.e., $PO_3H_2$) groups. Preferably, 1, 2, or 3 carbon atoms of the $(C_6–C_{16})$alkyl can be interrupted with 1, 2, or 3 nitrogen (i.e., N) atoms.

Suitable alkylaminophosphonic acids include diethylenetriamine penta(methylene phosphonic acid), which is commercially available as Dequest 2060S from Solutia Inc. (St. Louis, Mo.); ethylene diamine tetra(methylene phosphonic acid), which is commercially available as Dequest 2041 from Solutia Inc. (St. Louis, Mo.); and amino tri (methylenephosphonic acid), which is commercially available as Dequest 2000 from Solutia Inc. (St. Louis, Mo.).

The hydroxyalkylphosphonic acid can be $(C_1–C_6)$alkyl substituted on carbon with one or more hydroxy groups and substituted on carbon with one or more phosphonic acid (i.e., $PO_3H_2$) groups. Preferably, the $(C_1–C_6)$alkyl can be substituted on carbon with one hydroxy group. Preferably, the $(C_1–C_6)$alkyl can be substituted on carbon with two phosphonic acid (i.e., $PO_3H_2$) groups.

One suitable hydroxyalkylphosphonic acid is 1-hydroxyethylene-1,1-diphosphonic acid, which is commercially available as Dequest 2010 from Solutia Inc. (St. Louis, Mo.).

The alkylphosphonic acid carboxylic acid can be $(C_3–C_{16})$alkyl substituted on carbon with one or more phosphonic acid (i.e., $PO_3H_2$) groups and substituted on carbon with one or more carboxylic acid (i.e., COOH) groups. Preferably, the $(C_3–C_{16})$alkyl can be substituted on carbon with one phosphonic acid (i.e., $PO_3H_2$) group. Preferably, the $(C_3–C_{16})$alkyl can be substituted on carbon with three carboxylic acid (i.e., COOH) groups.

One suitable alkylphosphonic acid carboxylic acid is 2-phosphonobutane-1,2,4-tricarboxylic acid, which is commercially available as Dequest 7000 from Solutia Inc. (St. Louis, Mo.).

One or more mineral acids are present in an amount such that the pH of the composition is less than about 6.0 Preferably, the pH of the composition is less than about 4.5, less than about 3.0, less than about 2.5, or less than about 2.0.

As used herein, a mineral acid is an acid comprising an inorganic element that occurs naturally in the earth's crust or atmosphere, e.g., hydrogen, nitrogen, sulfur, phosphorous, chlorine, fluorine, bromine, or iodine. Suitable mineral acids include, for example, hydrochloric acid, sulfuric acid, nitric acid, phosphoric acid, hydrobromic acid, sulfamic acid, and hydrofluoric acid. As such, any combination of the above mineral acids can be employed in any suitable amount such that the pH of the composition is less than about 6.0, provided the composition can effectively remove proteinaceous material and provided none of the components of the composition has a significant residual kill activity, especially in the dairy industry.

The composition can optionally include a hydrotope. Any suitable hydrotope can be employed, provided the composition can effectively remove proteinaceous material and provided the hydrotope does not have a significant residual kill activity, especially in the dairy industry. Specifically, the hydrotope can be an aromatic sulfonic acid salt of the formula:

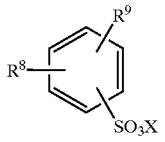

or of the formula:

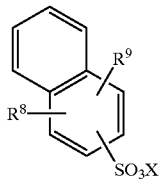

wherein $R^8$ and $R^9$ are each independently $(C_1–C_6)$alkyl wherein any alkyl can be substituted with one or more hydroxy;

X is sodium, potassium, lithium, or $^+NHR^{10}R^{11}R^{12}$, wherein $R_{10}–R^{12}$ are each independently H or $(C_1–C_6)$ alkylene, wherein the alkylene can be substituted with one or more hydroxy.

A preferred value for $R^8$ is methyl, ethyl, propyl, or iso-propyl. More preferably, $R^8$ is methyl. A preferred value for $R^9$ is methyl, ethyl, propyl, or iso-propyl. More preferably, $R^9$ is methyl. A preferred value for X is sodium (i.e., Na).

The aromatic sulfonic acid salt can be present in any suitable amount of the composition, provided the composition can effectively remove proteinaceous material and provided none of the components of the composition has a significant residual kill activity, especially in the dairy industry. Preferably, the aromatic sulfonic acid salt can be present in about 0.0001 wt. % of the composition to about 5.0 wt. % of the composition. More preferably, the aromatic sulfonic acid salt can be present in about 0.0005 wt. % of the composition to about 0.5 wt. % of the composition.

Suitable aromatic sulfonic acid salts include sodium xylene sulfonate, which is commercially available as Stepanate SXS (CAS # 1300-72-7) from Stepan or a distributor of Stepan, such as Milsolv Corporation (Roseville, Minn.); sodium naphthalene sulfonate; and sodium cumene sulfonate.

The composition can be formulated in any suitable manner, provided each of the components maintains its stability during and after the formulation process, provided the composition can effectively remove proteinaceous material, and provided none of the components of the composition will have a significant residual kill activity, especially in the dairy industry. In the event some of the components of the cleaning composition are incompatible in a concentrated form, the cleaning composition can be formulated at use-level concentrations by combining two or more formulated component concentrates. Preferably, each of the surfactant, emulsifier, and chelating agent, in any order, are contacted with water. More preferably, each of the above components are added to water. The one or more mineral acids can then be contacted with the aqueous mixture. Preferably, the one or more mineral acids can then be the added to the aqueous mixture. The resulting acidified mixture can then be heated, stirred, shaken, or agitated to facilitate each of the components to effectively dissolve in the water.

The present invention also provides a method for removing proteinaceous material from a surface having proteinaceous material located therein. The method includes (1) contacting the surface with an effective amount of a composition of the present invention and for a period of time effective to remove the proteinaceous material and (2) removing the proteinaceous material from the surface.

The proteinaceous material can be located on any surface that comes into contact with any suitable dairy equipment. Suitable dairy equipment include a cheese vat, fast-food milkshake machine, pasteurizer, whey evaporator, permeate evaporator, ultra-high temperature dairy processing equipment, and a mixing vessel used to make dairy-based products that require heating. As such, the composition of the present invention can effectively remove proteinaceous material from a cheese vat, fast-food milkshake machine, pasteurizer, whey evaporator, permeate evaporator, ultra-high temperature dairy processing equipment, or a mixing vessel used to make dairy-based products that require heating.

The surface having the proteinaceous material can be contacted with the composition in any suitable manner. The composition can be applied to the surface, for example, by brushing the surface with the composition, by spraying the surface with the composition, by wiping the surface with the composition, by soaking the surface with the composition, by CIP (clean-in-place circulation cleaning), or any combination thereof. The size and shape of the surface to be contacted can influence the manner in which the surface can be contacted. As such, it may be more effective to spray the surface of a cheese vat with the composition while it may be more effective to wipe, brush or soak the surface of a fast-food milkshake machine with the composition.

The proteinaceous material can be removed in any suitable manner, provided the proteinaceous material is effectively dislodged from the surface. The proteinaceous material can be removed, for example, by scrubbing the surface having the proteinaceous material, by scraping the surface having the proteinaceous material, by wiping the surface having the proteinaceous material, or by spraying the surface having the proteinaceous material. The size and shape of the surface where the proteinaceous material is removed can influence the manner in which the proteinaceous material can be removed. As such, it may be more effective to spray the surface of a cheese vat to remove the proteinaceous material while it may be more effective to wipe, brush or soak the surface of a fast-food milkshake machine to remove the proteinaceous material.

The period of time in which the surface having the proteinaceous material is contacted with the composition can depend on several factors. The period of time can depend, for example, on the amount and nature of the proteinaceous material. In addition, the period of time can depend on the size, shape, and temperature of the surface area to be cleansed. Typically, the period of time can be from about 1 minute to about 120 minutes. Preferably, the period of time can be about 3 minutes to about 15 minutes.

The effective amount of composition can depend on several factors. The effective amount of composition can depend, for example, on the amount and nature of the proteinaceous material. In addition, the effective amount of composition can depend on the size, shape, and temperature of the surface area to be cleansed. Typically, the effective amount of composition can be an amount sufficient to effectively cover the area of the surface having the proteinaceous material.

The effectiveness of the composition in removing proteinaceous material can depend on the temperature of the surface in which the surface is cleaned or the temperature of the composition. Preferably, the temperature of the surface or the temperature of the composition can be above room temperature (i.e., 69° F.). More preferably, the temperature of the surface or the temperature of the composition can be above about 90° F., can be above about 120° F., or can be above about 130° F. Most preferably, the temperature is maintained below 150° F. to minimize protein denaturization.

The surface can optionally be contacted with water before the surface is contacted with the composition. This can effectively loosen or dislodge some of the proteinaceous material from the surface. In addition, the surface can optionally be contacted with water after the surface is contacted with the composition. This can also effectively remove any residual amount of proteinaceous material remaining on the surface, as well as effectively removing the composition from the surface by rinsing the composition and/or proteinaceous material from the surface with an effective amount of water.

The surface can optionally be sanitized. The surface can be sanitized after the surface is contacted with the composition. In addition, the surface can be sanitized after the surface is contacted with water during the optional rinsing step. Any suitable method of sanitizing can be employed, provided the surface is effectively sanitized and the sanitation does not leave a reside of compound or compounds that have residual kill or activity, especially in the dairy process, on the surface.

The composition can be applied to a surface having proteinaceous material located therein. The surface having the proteinaceous material can be sprayed with the composition. The composition can remain on the surface for about 1 minute to about 5 minutes. The surface can then be scraped to dislodge the proteinaceous material. The surface can then be rinsed with water to remove the residual proteinaceous material remaining on the surface and to remove the composition remaining on the surface. It has surprisingly been discovered that the composition effectively removes the proteinaceous material from the surface but does not leave a residue of a compound or compounds that has a kill activity, especially in the dairy industry, on the surface. As such, the surface can be re-used, for example, in the dairy industry, without the existence of a compound or compounds remaining on the surface that would interfere with the dairy making process.

The invention will now be illustrated by the following non-limiting Examples.

EXAMPLE 1

Formulation of Composition (in wt. %)

| Component | Nominal Amount (Weight %) |
|---|---|
| Water | 94.88–99.99 |
| Plurafac LF-221 | 0.0002–0.2 |
| Glensurf 42 | 0.0001–0.1 |
| Dequest 2000 | 0.0005–0.5 |
| Stepanate SXS | 0.0005–0.5 |
| Phosphonic acid | 0.002–0.2 |
| Nitric acid | 0.029–2.9 |
| Sulfuric acid | 0.005–0.5 |

EXAMPLE 2

Use of the composition to clean a surface having proteinaceous material located therein.

Two gallons of a composition including about 94.88 wt. % to about 99.99 wt. % of water, about 0.0002 wt. % to about 0.2 wt. % of Plurafac LF-221, about 0.0001 wt. % to about 0.1 wt. % Glensurf 42, about 0.0005 wt. % to about 0.5 wt. % of Dequest 2000, about 0.0005 wt. % to about 0.5 wt. % of Stepanate SXS, and 0.036 wt. % to about 3.6 wt. % of a combination of phosphonic acid, nitric acid, and sulfuric acid is heated to about 120° F. The composition is sprayed on the surface of a 50 gallon cheese vat having proteinaceous material located therein through a sprayball connected to a recirculation pump. The composition is allowed to remain on the surface for about 1 minute to about 5 minutes. The surface is rinsed with water to remove the residual proteinaceous material remaining on the surface and to remove the composition remaining on the surface. The cheese vat is then used in the normal operation of the manufacturing of cheese or cheese products. The surface of the cheese vat does not contain any appreciable amount of a compound or compounds that could interfere with the cheese making process. As such, the dairy products that come into contact with the surface of the cheese vat during the manufacturing of cheese or cheese products are not harmed by any residual amount of compound or compounds from the above composition that remain on the surface.

All publications, patents, and patent documents are incorporated by reference herein, as though individually incorporated by reference. The invention has been described with reference to various specific and preferred embodiments and techniques. However, it should be understood that many variations and modifications may be made while remaining within the spirit and scope of the invention.

What is claimed is:

1. A composition suitable for removing proteinaceous material comprising water, an emulsifier, a chelating agent, one or more mineral acids, and a surfactant; wherein:

the emulsifier is a polyether nonionic emulsifier or an amine oxide;

the chelating agent is an alkylaminophosphonic acid, a hydroxyalkylphosphonic acid, or an alkylphosphonic acid carboxylic acid;

the one or more mineral acids are present in an amount such that the pH of the composition is less than about 4.5; and the surfactant is a compound of formula (I):

(I)

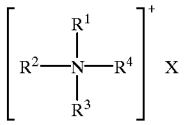

wherein $R^1$, $R^2$, and $R^3$ are independently $(C_1–C_6)$alkyl, wherein any alkyl group can be substituted with one or more $(C_1–C_6)$alkoxy or hydroxy;

$R^4$ is $$—[R^5—O]_q—H$$

or $$—[R^6—O]_q—[R^7—O]_r—H$$

wherein $R^5$ and $R^6$ are independently $(C_1–C_6)$alkylene wherein any alkylene group can be substituted with one or more $(C_1–C_6)$alkoxy or hydroxy;

$R^7$ is $(C_1–C_6)$alkylene wherein the alkylene group can be substituted with one or more $(C_1–C_6)$alkoxy or hydroxy;

q has an average value between about 1 and about 100;

r has an average value between about 1 and about 100; and

X is halo, $RCOO^-$, $PO_4^{2-}$ or $SO_4^{2-}$ wherein R is $(C_1–C_6)$ alkyl.

2. The composition of claim 1 wherein the emulsifier is a polyether nonionic emulsifier or an amine oxide; wherein the emulsifier is a compound of formula (III):

$$R^{10}—O—(R^{11}O)_m—[R^{12}O]_n—H \quad \text{(III)}$$

wherein $R^{10}$ is $(C_8–C_{20})$alkyl wherein the alkyl can be substituted with one or more $(C_1–C_6)$alkoxy or hydroxy or $(C_1–C_{12})$alkylphenol;

$R^{11}$ and $R^{12}$ are each independently $(C_1–C_6)$alkylene wherein each alkylene can be substituted with one or more $(C_1–C_6)$alkoxy or hydroxy;

m has an average value of about 5 to about 200;

n has an average value of about 0 to about 200; and wherein the amine oxide is a compound of formula (IV):

(IV)

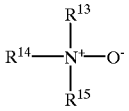

wherein $R^{13}$ and $R^{15}$ are each independently $(C_1–C_6)$alkyl wherein each alkyl can be substituted with one or more hydroxy; and $R^{14}$ is $(C_6–C_{16})$alky.

3. The composition of claim 2 wherein $R^{10}$ is $(C_{10}–C_{18})$ alkyl, wherein the alkyl is straight chained; $R^{11}$ is ethylene; $R^{12}$ is $CH_2CH_2CH_2CH_2$; n has an average value of about 1 to about 2; and m is has an average value of about 5 to about 50.

4. The composition of claim 1 wherein the polyether nonionic emulsifier is a nonionic linear alkoxylated primary alcohol and wherein the amine oxide is iso-alkyl dimethyl amine oxide.

5. The composition of claim 1 wherein the alkylaminophosphonic acids is diethylenetriamine penta(methylene phosphonic acid), ethylene diamine tetra(methylene phosphonic acid), or amino tri (methylene-phosphonic acid); the hydroxyalkylphosphonic acid is 1-hydroxyethylene-1,1-diphosphonic acid; and the alkylphosphonic acid carboxylic acid is 2-phosphonobutane-1,2,4-tricarboxylic acid.

6. The composition of claim 1 wherein the one or more mineral acids comprise hydrochloric acid, sulfuric acid, nitric acid, phosphoric acid, hydrobromic acid, hydrofluoric acid, sulfamic acid or any combination thereof.

7. The composition of claim 1 wherein the one or more mineral acids are present in an mount such that the pH of the composition is less than about 2.0.

8. The composition of claim 1 wherein $R^1$ is ethyl, $R^2$ is methyl, $R^3$ is ethyl, and $R^4$is $$—[R^5—O]_q—H$$

wherein $R^5$ is propylene and q has an average value of about 40.

9. The composition of claim 1 wherein the emulsifier is a nonionic linear alkoxylated primary alcohol or iso-alkyl dimethyl amine oxide; the chelating agent is 1-hydroxyethylidene-1,1-diphosphonic acid, 2-phosphonobutane-1,2,4-tricarboxylic acid, ethylenediamine tetra(methylenephosphonic acid), hexamethylenediamine tetra(methylenephosphonic acid), or diethylenetriamine penta(methylenephosphonic acid); the one or more mineral acids comprise hydrochloric acid, sulfuric acid, nitric acid, phosphoric acid, hydrobromic acid, hydrofluoric acid, or any combination thereof; the one or more mineral acids are present in an mount such that the pH of the composition is less than about 2.0; and the surfactant is PPG-40 diethylammonium chloride.

10. The composition of claim 1 wherein the water is present in about 94.88 wt. % to about 99.99 wt. % of the composition; the emulsifier is present in about 0.0002 wt. % to about 0.2 wt. % of the composition; the chelating agent is present in about 0.0005 wt. % to about 0.5 wt. % of the composition; the one or more mineral acids are present in a combined amount of about 0.036 wt. % to about 3.6 wt. % of the composition; and the surfactant is present in about 0.0001 wt. % to about 0.1 wt. % of the composition.

11. The composition of claim 1 further comprising a hydrotope.

12. The composition of claim 11 wherein the hydrotope is an aromatic sulfonic acid salt.

13. The composition of claim 12 wherein the aromatic sulfonic acid salt is a compound of the formula:

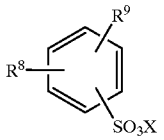

or of the formula:

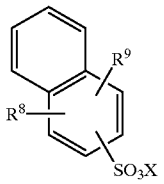

wherein $R^8$ and $R^9$ are each independently $(C_1–C_6)$alkyl wherein any alkyl can be substituted with one or more hydroxy;

X is Na, K, Li, or $^+NHR^{10}R^{11}R^{12}$, wherein $R^{10}–R^{12}$ are each independently H or $(C_1–C_6)$alkylene, wherein the alkylene can be substituted with one or more hydroxy.

14. The composition of claim 12 wherein $R^8$ is methyl, $R^9$ is methyl and X is Na.

15. The composition of claim 12 wherein the aromatic sulfonic acid salt is sodium xylene sulfonate, sodium naphthalene sulfonate, or sodium cumene sulfonate.

16. The composition of claim 11 wherein the hydrotope is present in about 0.005 wt. % to about 0.5 wt. % of the composition.

17. A method for removing proteinaceous material comprising:

contacting a surface comprising proteinaceous material with an effective amount of a composition and for an effective period of time to remove the proteinaceous material, wherein the composition comprises water, an emulsifier, a chelating agent, one or more mineral acids, and a surfactant; wherein:

the emulsifier is a polyether nonionic emulsifier or an amine oxide;

the chelating agent is an alkylaminophosphonic acid, a hydroxyalkylphosphonic acid, or an alkylphosphonic acid carboxylic acid;

the one or more mineral acids are present in an amount such that the pH of the composition is less than about 4.5; and the surfactant is a compound of formula (I):

(I)

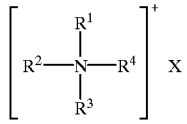

wherein $R^1$, $R^2$, and $R^3$ are independently $(C_1–C_6)$alkyl, wherein any alkyl group can be substituted with one or more $(C_1–C_6)$alkoxy or hydroxy;

$R^4$ is $$—[R^5—O]_q—H$$

or $$—[R^6—O]_q—[R^7—O]_rH$$

wherein $R^5$ and $R^6$ are independently $(C_1–C_6)$alkylene wherein any alkylene group can be substituted with one or more $(C_1–C_6)$alkoxy or hydroxy;

$R^7$ is $(C_1–C_6)$alkylene wherein the alkylene group can be substituted with one or more $(C_1–C_6)$alkoxy or hydroxy;

q has an average value between about 1 and about 100;

r has an average value between about 1 and about 100; and

X is halo, $RCOO^-$, $PO_4^{2-}$ or $SO_4^{2-}$ wherein R is $(C_1–C_6)$ alkyl; and removing the proteinaceous material from the surface.

18. The method of claim 17 wherein the emulsifier is a nonionic linear alkoxylated primary alcohol or iso-alkyl dimethyl amine oxide; the chelating agent is 1-hydroxyethylidene-1,1-diphosphonic acid, 2-phosphonobutane-1,2,4-tricarboxylic acid, ethylenediamine tetra(methylenephosphonic acid), hexamethylenediamine tetra(methylenephosphonic acid), or diethylenetriamine penta(methylenephosphonic acid); the one or more mineral acids comprise hydrochloric acid, sulfuric acid, nitric acid, phosphoric acid, hydrobromic acid, sulfamic acid or hydrofluoric acid; the one or more mineral acids are present in an mount such that the pH of the composition is less than about 2.0; and the surfactant is PPG-42 diethylammonium chloride.

19. The method of claim 17 wherein the proteinaceous material is located on the surface of a cheese vat, fast-food milkshake machine, pasteurizer, whey evaporator, permeate evaporator, ultra-high temperature dairy processing equipment, or a mixing vessel used to make dairy-based products that require heating.

20. The method of claim 17 wherein the water is present in about 94.88 wt. % to about 99.99 wt. % of the composition; the emulsifier is present in about 0.0002 wt. % to about 0.2 wt. % of the composition; the chelating agent is present in about 0.0005 wt. % to about 0.5 wt. % of the composition; the one or more mineral acids are present in a combined amount of about 0.036 wt. % to about 3.6 wt. % of the composition; and the surfactant is present in about 0.0001 wt. % to about 0.1 wt. % of the composition.

21. The method of claim 17 wherein the effective period of time is about 3 minutes to about 15 minutes.

22. The method of claim 17 wherein the surface comprising the proteinaceous material is contacted with the composition such that the temperature of the surface or the temperature of the composition is above about 120° F.

23. The method of claim 17 further comprising sanitizing the surface after the surface has been contacted with the composition.

24. A method for preparing a composition comprising water, an emulsifier, a chelating agent, one or more mineral acids, and a surfactant; wherein:

the emulsifier is a polyether nonionic emulsifier or an amine oxide;

the chelating agent is an alkylaminophosphonic acid, a hydroxyalkylphosphonic acid, or an alkylphosphonic acid carboxylic acid;

the one or more mineral acids are present in an amount such that the pH of the composition is less than about 4.5; and the surfactant is a compound of formula (I):

(I)

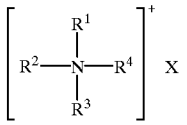

wherein $R^1$, $R^2$, and $R^3$ are independently $(C_1–C_6)$alkyl, wherein any alkyl group can be substituted with one or more $(C_1–C_6)$alkoxy or hydroxy;

$R^4$ is $$—[R^5—O]_q—H$$

or $$—[R^6—O]_q—[R^7—O]_r—H$$

wherein $R^5$ and $R^6$ are independently $(C_1–C_6)$alkylene wherein any alkylene group can be substituted with one or more $(C_1–C_6)$alkoxy or hydroxy;

$R^7$ is $(C_1–C_6)$alkylene wherein the alkylene group can be substituted with one or more $(C_1–C_6)$alkoxy or hydroxy;

q has an average value between about 1 and about 100;

r has an average value between about 1 and about 100; and

X is halo, $RCOO^-$, $PO_4^{2-}$ or $SO_4^{2-}$ wherein R is $(C_1–C_6)$alkyl; comprising combining the water, emulsifier, chelating agent, surfactant, and the one or more mineral acids, in any order, to provide the composition.

25. The method of claim 24 wherein the water, emulsifier, chelating agent, and surfactant are combined to form an aqueous mixture; and the aqueous mixture is combined with the one or more mineral acids to provide the composition.

26. The method of claim 24 wherein the emulsifier, chelating agent, and surfactant are added to the water.

27. The method of claim 24 wherein the one or more mineral acids are added to the aqueous mixture.

28. The method of claim 25 further comprising heating stirring, shaking, or agitating the aqueous mixture.

* * * * *